United States Patent [19]

Ketchum

[11] 3,958,551

[45] May 25, 1976

[54] COMPOUND BOW

[75] Inventor: Frank W. Ketchum, Jacksonville, Tex.

[73] Assignee: AMF Incorporated, White Plains, N.Y.

[22] Filed: Feb. 26, 1975

[21] Appl. No.: 553,140

[52] U.S. Cl. ..... 124/24 R; 124/35 A

[51] Int. Cl.[2] ..... F41B 5/00

[58] Field of Search ..... 124/23 R, 24 R, 30 R, 124/30 A, 35 A

[56] References Cited

UNITED STATES PATENTS

| | | | |
|---|---|---|---|
| 3,486,495 | 12/1969 | Allen | 124/24 R |
| 3,744,473 | 7/1973 | Nishioka | 124/30 R X |
| 3,841,295 | 10/1974 | Hunter | 124/30 A X |
| 3,851,638 | 12/1974 | Alexander | 124/30 R X |

*Primary Examiner*—Richard C. Pinkham
*Assistant Examiner*—William R. Browne
*Attorney, Agent, or Firm*—George W. Price; Walter Lewis

[57] ABSTRACT

Pairs of individually changeable cam wheels at the tips of a compound bow for selective adjustment of the weight and draw length of the bow. The wheels have halves having different size grooves, said halves being interchangeable thus offering a full range of different weight and draw length bows.

3 Claims, 8 Drawing Figures

COMPOUND BOW

This invention relates to a compound bow, and more particularly to means for making independent selective adjustments in the weight and draw length of the bow.

One type of compound bow is illustrated in Allen U.S. Pat. No. 3,486,495 (1969). In this bow, oval or circular eccentric grooved wheels are provided at the bow tip ends. The bow string is strung around the eccentric wheels. These eccentric wheels provide a mechanical advantage to increase the amount of energy stored in the bow before full draw, and then a let off in the amount of force required to hold the string at full draw.

The wheels have a pair of grooves therein, one for the let off side or central stretch of the bow string, and the other for the take up side or end stretches of the string. Some adjustments can be made to the bow by changing the size of the wheels, but this is limited. This is because heretofore each time the wheel was changed both grooves were changed. For example, to get an appreciable increase in the draw length, a larger wheel was selected. However, a larger wheel resulted in stressing the bow beyond its maximum rated weight. Of course, reducing the size of the wheel to reduce the draw length meant that the bow was being operated below its capacity.

In the invention, each side of the wheel is adjusted independent of the other side. Thus, for example, in order to increase the draw length, just the central stretch groove or let off side of the wheel is enlarged, but not the other groove or take up side of the wheel. This means that with the increased draw length the bow continues to operate at or near its maximum rated capacity.

The invention will be better understood by considering the following detailed description taken in connection with the accompanying two sheets of drawing in which.

Figures 1, 2:
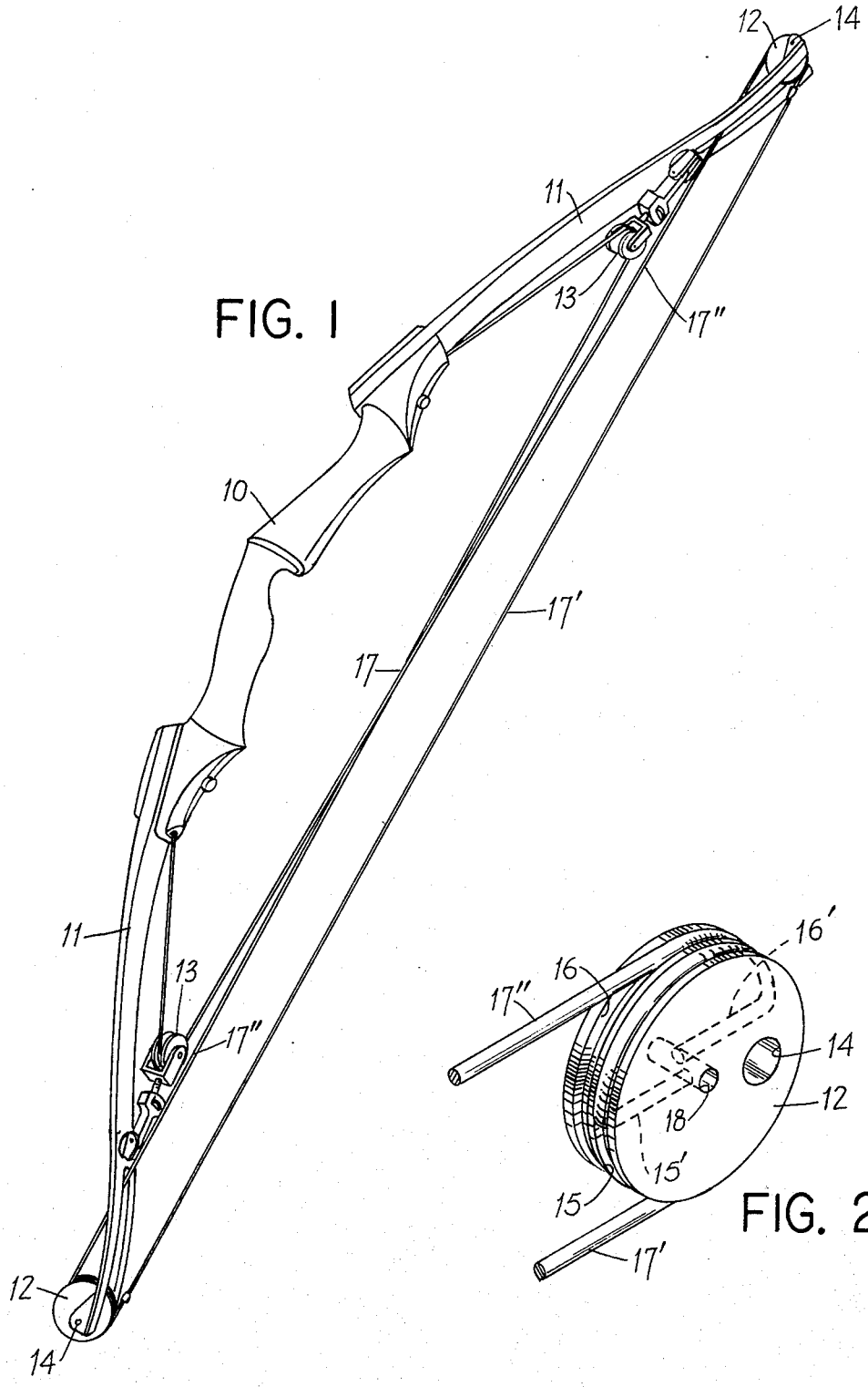
FIG. 1 is a perspective view of a compound bow of the prior art.
FIG. 2 is an enlarged perspective view of the wheel at the upperend of FIG. 1.

Referring now first to FIG. 1, the compound bow comprises a central handle 10, a pair of resilient limbs 11, eccentric wheels 12, a pair of idler pulleys 13, and a bow string 17 strung around the wheels and pulley and anchored at its opposite ends to the opposite ends of the handle.

Referring now also to FIG. 2, the wheels 12 are rotatably mounted on eccentrics 14. The wheels 12 have a pair of grooves 15, 16 formed therein. The bow string 17 has a central stretch 17'. Opposite ends of the central stretch 17' are disposed in grooves 15 for almost a full turn and then go in a radial hole 15' to an axial hole 18. From the axial hole 18, end stretch 17'' of the string 17 continues out through another radial hole 16' to the groove 16 for about a quarter of a turn and then along the length of the bow to the opposite idler pulley 13 and then to the adjacent end of the handle 10. The central and end stretches 17' and 17'' are shown as being discontinuous, but they in effect are continuations of each other and can in fact be actual continuations of each other provided means is provided to prevent slippage of the string in the grooves. In the design shown in FIG. 2, a not shown pin or the like is driven into the axial bore 18 to pinch the adjacent ends of string ends 17' and 17'' to prevent them from slipping on the wheel 12. As heretofore stated, it has been the practice to make adjustments in the draw length by changing the size of the wheel. This resulted in more or less string or cable in the groove 15, but the same was also true for groove 16. In other words, by merely changing the size of the wheel it was not possible to make selective adjustments in just the weight or draw length of the bow. My invention shows how this can be readily accomplished, at low cost, plus providing other advantages.

Figure 3:
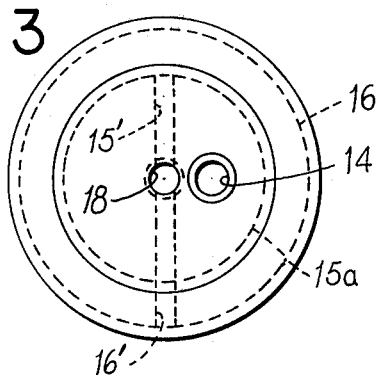
FIGS. 3 and 4 are side elevation views of one form of the invention.
Figure 4:
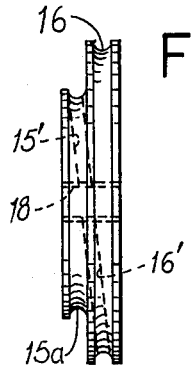

Referring now to FIGS. 3 and 4, in this form of the invention, a replacement two-step integral wheel is provided in which the groove 16 is the same size as in FIG. 2, whereas the size of groove 15a is reduced from that of 15 in FIG. 2, so that the draw length is changed but without changing the weight of the bow.

Figure 5:
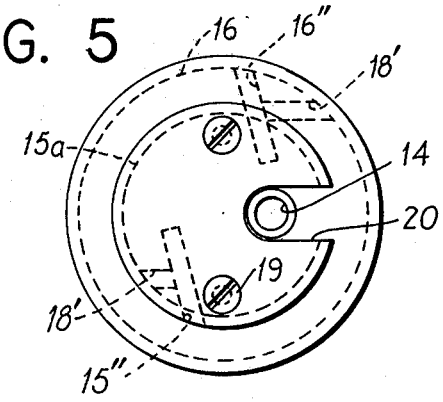
FIGS. 5 and 6 are side elevation views of a second form of the invention.
Figure 6:
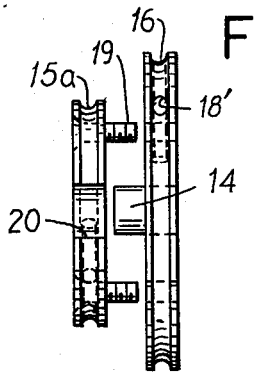

In the form of the invention shown in FIGS. 5 and 6 another two-step wheel is shown as in FIGS. 3 and 4; however, here the two parts are separably joined together by means such as studs 19 so that with such an arrangement of the parts a great plurality of different sized wheel halves can be interchanged with each other to readily selectively change the bow weight and/or draw length. The holes 15'', 16'' and 18' in FIG. 5 correspond in purpose to the holes 15', 16' and 18 of FIGS. 2 and 3. In addition, however, the bearing 14 for the eccentric axis in FIG. 5 is formed just in the take up or end stretch side of the wheel (that is, just the part having the groove 16). This provides the advantage that, as compared to FIGS. 2 and 3, the entire wheel does not have to be unstrung and removed from its pivotal mounting on the bow ends in order to adjust just the draw length. By virtue of the studs 19 and slot 20, it is necessary to change just the central stretch 17' and the part of the let off or central stretch side of the wheel (that is, just the part having the groove **15*a*) in order to change the draw length. That is to say, the part of the wheel having the groove 16 and the end stretches 17''** do not have to be disassembled in order to change just the draw length, and in changing the draw length the weight of the bow is in no way affected.

It will be seen that by using the approach of FIGS. 5 and 6 the invention makes it possible to economize on the number of parts required to make a wide range of adjustments in the draw length and/or weight of the bow. That is to say, by providing a set of wheel halves having different size grooves **15*a* and another set of wheel halves having different sizes grooves 16**, which can be interchanged, a full range of compound bows having different weights and draw lengths is provided for at the time of manufacture and also for the end user as well.

Figure 7:
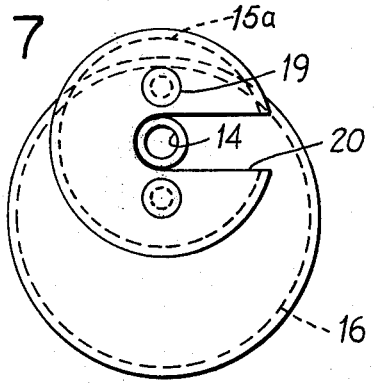
FIGS. 7 and 8 are side elevation views of a third form of the invention.
Figure 8:
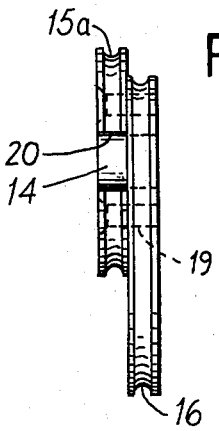

The embodiment of the invention illustrated in FIGS. 7 and 8 is similar in principle to that of FIGS. 5 and 6, except that the wheel part having the groove **15*a* is not on an eccentric axis. That is to say, the axis 14 is an eccentric one for the part having the groove 16, but a concentric one for the part having the groove 15*a*. This is because both wheel halves do not have to be on an eccentric, as shown in Allen U.S. Pat. No. 3,486,495, in order to obtain a drop off in the amount of force required to hold the bow at full draw. In order to achieve a drop off it is necessary for only the wheel part having the groove 16** (that is, the take up or end stretch side) to be rotatable about an eccentric axis.

I claim:

1. In a compound bow having a central handle, a pair of resilient limbs, a bow string spanning the ends of said limbs, and a mechanical advantage device at the ends of said limbs for said string to increase the energy input into said bow and then reduce the force required to hold said string at full draw, the improvement of each of said devices comprising a rotatable wheel assembly having two side by side wheels of unequal diameter which are adapted to turn in unison about a common axis, each of said wheels having a circumferential groove formed therein, the opposite ends of the central stretch of said string being disposed in one of said grooves, the end stretches of said string being disposed in the other of said grooves, and means for adjusting the draw length of said bow independent of the same energy input to said bow, said means comprising replacement means to change just the size of the grooves for the central stretch of said string.

2. In a compound bow as in claim 1, wherein said two side by side wheels of said rotatable wheel assemblies are integral with each other, and said replacement means comprises at least two other such two wheel integral assemblies, the wheels of all said assemblies having the grooves therein for said end stretches being of equal diameter, and the other wheels of said two other wheel assemblies having equal, but different diameters from the corresponding wheels of the first two mentioned wheel assemblies to provide different draw lengths for said bow independent of the same energy input thereto.

3. In a compound bow as in claim 1, wherein said two side by side wheels of said rotatable wheel assemblies are separably connected to each other, said replacement means comprising at least two other wheels for substitution for the wheels of said assemblies having the grooves therein for said central stretch, and said last mentioned wheels and said two other wheels having different diameters to provide different draw lengths for said bow independent of the same energy input thereto.

* * * * *